US006089556A

United States Patent [19]

Whiteford

[11] Patent Number: 6,089,556

[45] Date of Patent: Jul. 18, 2000

[54] WOODWORKER'S CLAMP

[76] Inventor: Carlton L. Whiteford, 3 High Point Rd., Westport, Conn. 06680

[21] Appl. No.: 09/395,269

[22] Filed: Sep. 13, 1999

Related U.S. Application Data

[60] Provisional application No. 60/101,978, Sep. 28, 1998.

[51] Int. Cl.[7] ..... B25B 1/02

[52] U.S. Cl. ..... 269/149; 269/3; 269/143; 269/249; 269/207; 269/901

[58] Field of Search ..... 269/149, 143, 269/3, 6, 58, 207, 901, 900, 249

[56] References Cited

U.S. PATENT DOCUMENTS

| | | | |
|---|---|---|---|
| 870,761 | 11/1907 | Benson | 269/149 |
| 1,241,215 | 9/1917 | Hoffman | 269/149 |
| 1,272,259 | 7/1918 | Herold | 269/149 |
| 1,354,378 | 9/1920 | Carpenter | 269/149 |
| 1,484,794 | 2/1924 | Moses | 269/149 |
| 1,583,611 | 5/1926 | Seely | 269/149 |
| 2,255,320 | 9/1941 | Kotchi | 269/149 |

*Primary Examiner*—David A. Scherbel
*Assistant Examiner*—Lee Wilson
*Attorney, Agent, or Firm*—Spencer E. Olson

[57] ABSTRACT

A hand tool or clamp, capable of clamping a work-piece of any size within a wide range of sizes, includes a fixed jaw secured to one end of a slide bar, the other end of which is received in an elongate hollow sleeve and supported for back and forth movement relative to the sleeve. A movable jaw is supported on said sleeve at a selected one of plural mounting locations spaced along the length of the sleeve, each defined by a transverse pin extending through the sleeve. Once the fixed jaw has been advanced by hand toward the movable jaw sufficiently to clamp the work-piece, the sleeve and slide bar are releasably locked together by a pawl and ratchet mechanism. The clamping pressure is increased over that provided by hand by a screw mechanism associated with the fixed jaw.

15 Claims, 3 Drawing Sheets

(0" - 6")
(6" - 16")
(16" - 24")
1A
10
12
12A
14
14A
16
18
18A
20
22
24
26
50
64
68
70
74
76
78
80
82

WOODWORKER'S CLAMP

This application claims the benefit of U.S. Provisional Application No. 60/101,978 filed Sep. 28, 1998.

BACKGROUND OF THE INVENTION

This invention relates generally to clamps of the type used to temporarily clamp two articles together, for example, for gluing, or to hold a work-piece for welding or other operation, and more particularly, to a quick-action clamp capable of clamping work-pieces having a wide range of sizes.

Clamps of various configurations are old and well known, among them traditional parallel wood clamps, long used by woodworkers, and available in several capacities to accommodate a variety of clamping situations. Their effectiveness is limited, however, in that many different clamps are required to accommodate a range of work-piece sizes. For example, six traditional wood clamps ranging in size from four inches to eighteen inches are required to clamp work-pieces varying in thicknesses from zero to eighteen inches.

A relatively recent entry into the prior art is the quick-action "Quick Grip" clamp marketed by Peterson Manufacturing Co., Inc. This clamp has a movable jaw which is rapidly movable over both short and long distances to clamp against a work-piece, and is operable with one hand. The movable jaw is connected to one end of a movable slide bar and a stationary jaw is supported on the slide bar by a support structure including a trigger handle grip which releasably engages the slide bar and advances the movable jaw toward the fixed jaw. Four of these clamps ranging in opening size from six inches to twenty-four inches are required to clamp work-pieces varying in thickness from zero to twenty-four inches. It also has the disadvantage that once the jaws are initially clamped against a work-piece, the lever mechanism is so constructed that the hand cannot apply sufficient force on the trigger handle to advance the movable jaw by another increment, with the consequence that the clamp lacks the power to adequately clamp two articles together.

Thus, there is a need for a universal clamp, for use by woodworkers and others, capable of clamping a work-piece of any size within a relatively large range, say, between essentially zero and twenty-four inches, while having a closed length significantly shorter than the maximum opening of the clamp, and is capable of providing large clamping forces.

SUMMARY OF THE INVENTION

The clamp in accordance with the present invention is capable of clamping work-pieces of a wide range of sizes, for example, from a jaw spacing of substantially zero to a spacing of twenty-four inches, while having a closed length shorter than the maximum opening. The clamp includes an elongate slide bar having a fixed jaw secured to one end, the other end of which end is received in an elongate extension sleeve and supported for back and forth movement relative to the sleeve. A movable jaw is releasably supported on the extension sleeve at a selected one of plural locations (three in the described embodiment) spaced along the length of the sleeve, each locsation being defined by a transverse pin extending through the sleeve.

Once the fixed and movable jaws have been advanced toward one another sufficiently to clamp a work-piece therebetween, the sleeve and slide bar are releasably locked in adjusted position by a pawl and ratchet mechanism. Then, the clamping force is increased over that provided by hand by a screw mechanism associated with the fixed jaw which adjusts its angle of tilt relative to the axis of the slide bar.

Accordingly, it is an object of the present invention to provide a bar clamp capable of clamping a work-piece of any size within a relatively large range, while having a closed length shorter than its maximum jaw opening.

Another object of the invention is to provide a bar clamp having a movable jaw which is quickly and easily movable in large increments relative to a fixed jaw.

BRIEF DESCRIPTION OF THE DRAWINGS

Other objects, features and advantages of the invention will become apparent, and its construction and operation better understood, from the following detailed description, taken in conjunction with the accompanying drawings, in which.

DETAILED DESCRIPTION OF THE PREFERRED EMBODIMENT

Figures 1, 1A, 2, 3:
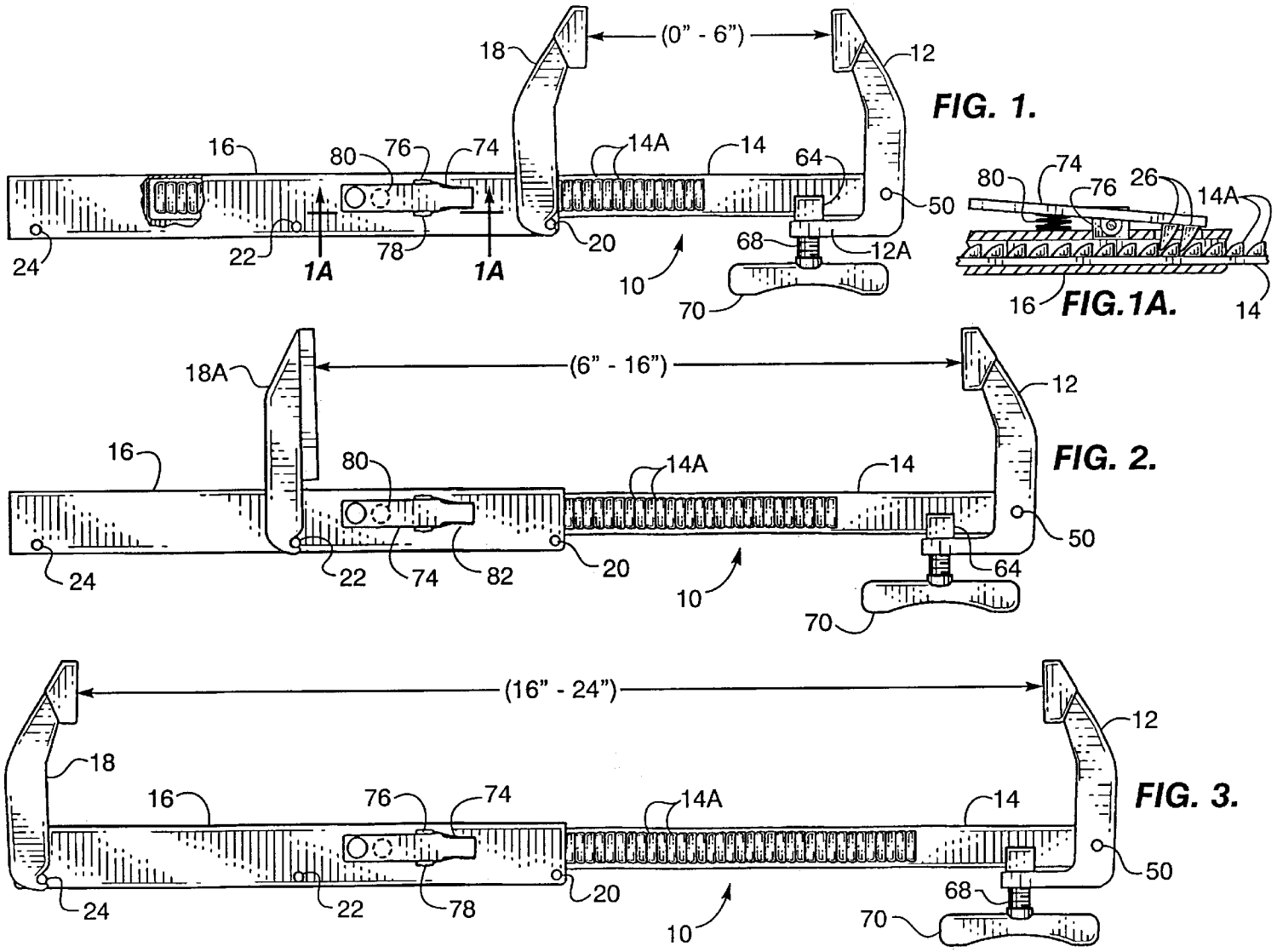
FIG. 1 is an elevation view of a clamp constructed in accordance with the invention arranged and adjusted to clamp work-pieces of a first range of sizes.
FIG. 1A is a sectional view taken along line 1A—1A in FIG. 1.
FIG. 2 is an elevation view of the clamp arranged and adjusted to clamp work-pieces of a second larger range of sizes.
FIG. 3 is an elevation view of the clamp arranged and adjusted to clamp work-pieces of a third, still larger, range of sizes.
Figure 4:
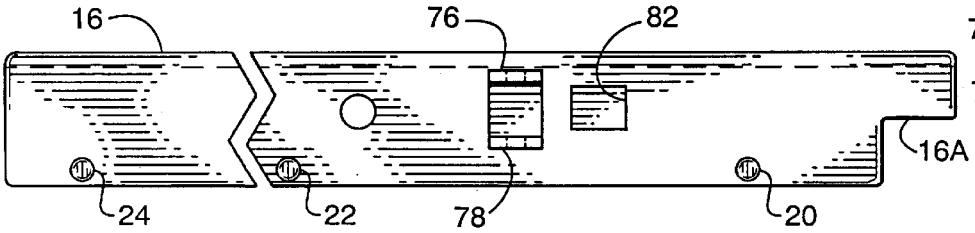
FIGS. 4 and 4A are, respectively, side elevation and end views of an extension sleeve forming part of the clamp.
Figure 4A:
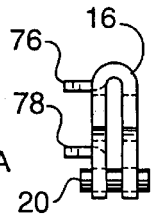

Referring to the drawings, the universal clamp 10 according to the invention, shown adjusted to three different sized jaw openings in FIGS. 1, 2 and 3, has a fixed pivoting jaw 12 secured to one end of a flat elongate slide bar 14, preferably made of steel. The other end of the slide bar is received by and is supported within an extension sleeve 16, preferably made of aluminum, having a top wall of inverted "U"-shape and adjacent side walls, further details of which are shown in FIGS. 4 and 4A and will be described presently. Slide bar 14 is slightly narrower than the width of the sleeve side walls and slightly thinner than the spacing between the walls. The lower edge of slide bar 14 is supported on transverse pins spaced along the lower edge of sleeve 16 for sliding movement of the bar relative to the sleeve. A movable jaw, which may be either the swivel-head type shown at 18 in FIGS. 1, 3 and 5, or the K-body type shown at 18A in FIG. 2 and in greater detail in FIGS. 6 and 6A, is supported on the sleeve at a selected one of three locations. In all cases the movable jaw is supported in easily releasable engagement at a selected one of three mounting locations defined by transverse pins 20, 22 and 24, respectively, one near each end of he sleeve and a third located substantially equidistant from the ends. Each transverse pin extends a short distance from either side of extension sleeve 16 and provides support for a movable jaw mounted on the sleeve.

Figure 6B:
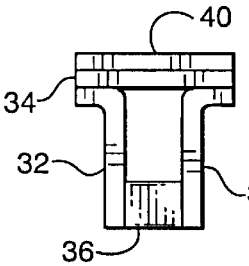
FIGS. 6, 6A and 6B are, respectively, side elevation, edge and top views of a movable jaw of the K-body type.
Figure 6A:
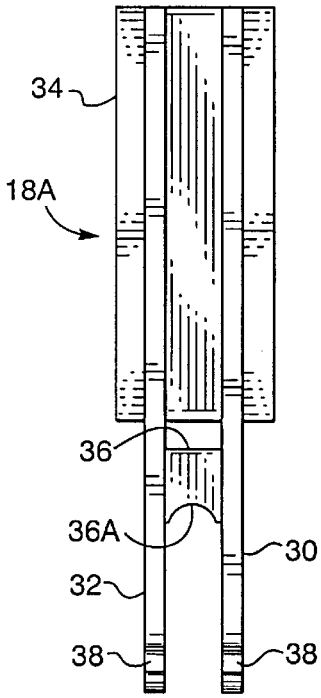
Figure 6:
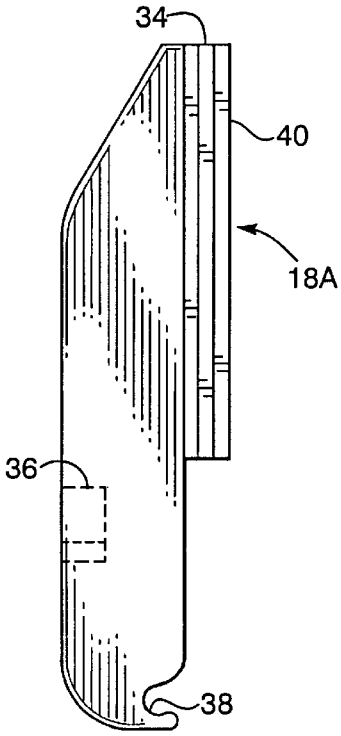

As the movable jaw is mounted on extension sleeve 16 in substantially the same way, regardless of type, it will suffice to describe in detail the construction and mounting of the K-body jaw 18A, illustrated in FIGS. 6, 6A and 6B. The jaw includes supporting structure comprising a pair of steel plates 30 and 32 disposed and secured over a portion of their length, as by welding, to a rectangularly-shaped steel plate 34. Between plates 30 and 32, immediately below the lower edge of plate 34, is a steel block 36, the lower surface 36A of which is contoured to substantially match the inverted "U" contour of the top wall of extension sleeve 16. Each of plates 30 and 32 has a hook-like cutout 38 near its lower end. Plate 34 may be covered with a rubber pad 40 if desired.

The jaw assembly 18A is placed astride extension sleeve 16, which has about the same thickness as the spacing between plates 30 and 32, with the contour 36A of block 36 engaging the contoured upper wall of extension sleeve 16, and with the hook-like cutouts 38 engaging the projecting ends of a selected one of the three pins 20, 22 and 24 which extend transversely of and beyond the side walls of the sleeve. Clamping pressure applied to the jaw face 34 (or 40 if there is a pad) causes the jaw structure to pivot about the block 36, thereby to increase the contact pressure between the cutouts 38 and the pin. Conversely, the jaw is easily removable, for use at a different pin location for example, simply by rocking the jaw forward sufficiently to disengage the hook.

Figure 5:
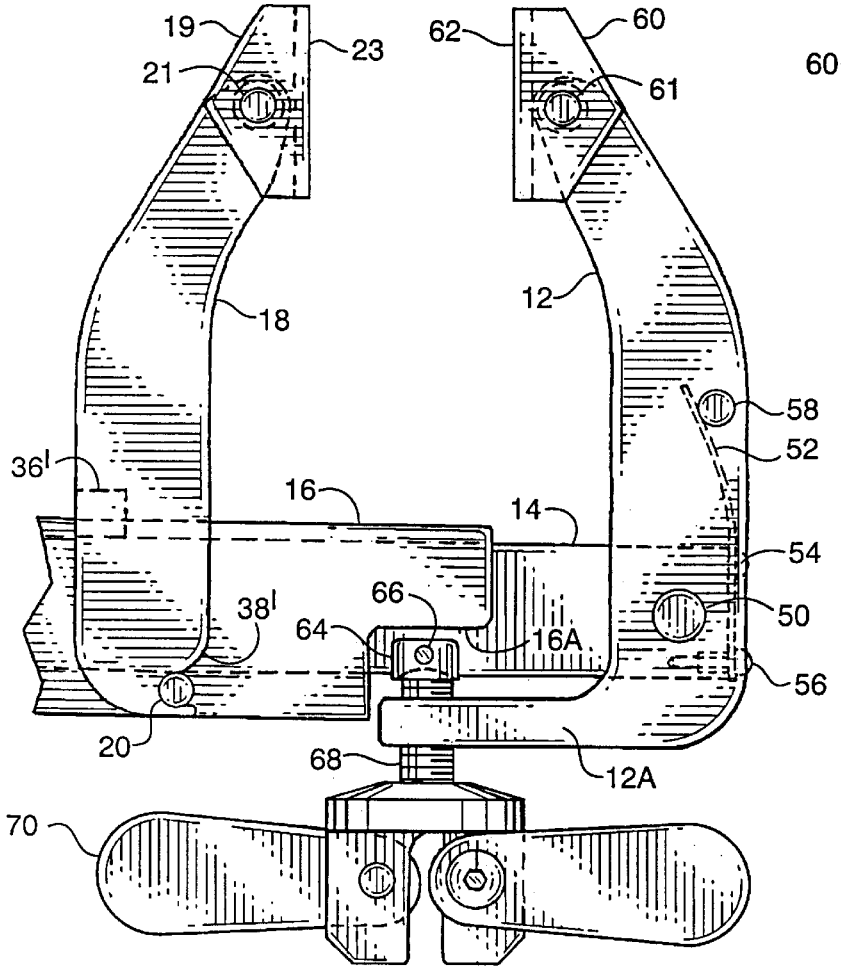
FIGS. 5, 5A and 5B are, respectively, elevation, side and top views of the right-hand end of the clamp as viewed in FIG. 1.
Figure 5A:
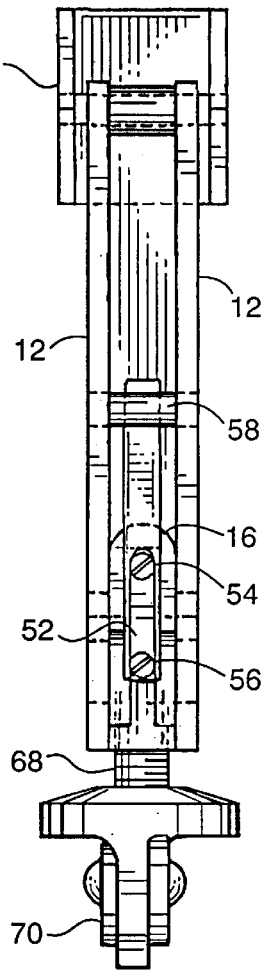
Figure 5B:
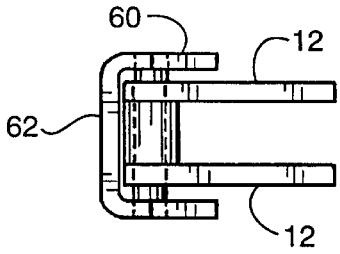

As seen in FIG. 5, the swivel-type jaw 18 is similar in construction to the K-type jaw 18A in that it includes supporting structure comprising curved steel plates spaced from one another by a contoured steel block 36' which matches the contour of the top wall of extension sleeve 16. Each plate also has a hook-like cutout 38' at its lower end, which engages the projecting ends of a transverse pin, in this case, pin 20. A jaw member 19 pivotally connected to jaw 18, near its upper end, is free to pivot about a pivot pin 21 and has a clamping surface 23 which opposes the clamping surface 62 of a swivelled jaw member 60 pivotally connected near the upper end of the supporting structure for fixed jaw 12.

Fixed jaw 12 is pivotally supported on a transverse pivot pin 50 located near the end of slide bar 14 and is biased away from movable jaw 18 by a leaf spring 52. One end of the leaf spring is secured to the end of slide bar 14 with a pair of screws 54 and 56, and the other end engages the inner surface of a transverse pin 58 which extends between the pair of spaced plates which support the jaw member Jaw member 60 is pivotally connected at the upper extremity of the support structure, enabling its clamping surface 62 to move into parallelism with the clamping surface 21 of jaw member 19.

Reverting to FIGS. 1 and 1A, slide bar 14 is maintained at an adjusted clamping position within the extension sleeve 16 by a finger-actuated pawl and ratchet mechanism. More particularly, slide bar 14 has on one of its side surfaces a multiplicity of ratchet teeth 14A uniformly distributed over a major portion of its length. In an operative embodiment wherein the extension sleeve 16 is approximately fifteen inches long and slide bar 14 is approximately seventeen inches long, the ratchet teeth are distributed along an approximately 12-inch long portion, starting from the encased end. The teeth typically are spaced ¼-inch apart and face the fixed clamp 12. The slide bar is maintained in an adjusted position relative to the extension sleeve by engaging the teeth 14A with a finger-actuable spring-biased pawl mechanism mounted on the outside of the sleeve. As seen in FIGS. 1A and 4, the pawl mechanism includes a flat, elongate lever arm 74 pivotally supported near one end on a pair of trunions 76, 78 bent out from the side wall of the sleeve. The left-hand end of lever arm 74 is urged outwardly by a compression spring 80 positioned between the arm and the sidewall, forcing the other end inwardly, through a rectangular opening 82 formed in the extension sleeve wall, into engagement with the confronting teeth 14A on the slide bar. The engaging end of the lever arm has two pawl teeth 26 arranged to always engage two ratchet teeth.

It will be understood that it is not necessary to actuate the pawl mechanism in order to move the movable jaw toward a clamping position with the fixed jaw; the pawl simply ratchets over the ratchet teeth 14A during relative movement of the jaws toward one another and snaps to engage the teeth in response to the clamping pressure exerted on the jaws by a work-piece. The clamp is released by pushing the left-hand end of lever arm 74 down against compression spring 80 to disengage the pawl from the slide bar teeth.

Reverting to FIG. 5, the support structure for fixed jaw 12 further includes means for increasing the clamping pressure between the jaws over that applied by hand in moving the jaws into a desired adjusted position. More particularly, each of the spaced plates forming the jaw structure 12 has an inwardly extending integral arm 12A disposed substantially parallel to the longitudinal axes of extension sleeve 16 and slide bar 14, and terminating within a cutout 16A formed in the end of extension sleeve 16. A steel block 64 is mounted astride the lower edge of slide bar 14, inwardly from pivot pin 50 and within the cutout 16A, and is secured there by a pin 66. The downwardly facing surface of block 64 has a spherical contour which is engaged by a similarly contoured end of a threaded bolt 68 which engages a threaded opening extending through arm 12A. The bolt 68 is rotatable in either direction by a handle 70 for adjusting the angle of tilt of the support structure 12 for fixed jaw 12 relative to the axis of slide bar 14.

Once the movable and fixed jaws have been advanced toward one another sufficiently to clamp the work-piece between them, tilting the jaw structure 12 toward the movable jaw greatly increases the clamping pressure between the jaws. The handle 70 has relatively long wings for maximizing the torque applied by the user, which when positioned transversely of slide bar 14 and then placed on a flat surface, serves to position the clamp to receive one or more work-pieces, thereby to free both hands of the user to do other things, such as manipulating the clamp into clamping engagement with the work-pieces.

The universality of the clamp will be evident from examination of FIGS. 1–3 which illustrate the range of clamping capacity made possible by the relative movement between the slide bar and extension sleeve and the option of being able to support the movable jaw at one of three locations spaced along the length of the sleeve. In an operational clamp having slide bar and extension sleeve lengths of approximately seventeen and fifteen inches, respectively, and a pin spacing of about seven inches, when the movable jaw 18 is supported on pin 20, at the innermost end of the sleeve, as shown in FIG. 1, a work-piece of any size within the range from essentially zero and up to six inches can be clamped between the jaws. When the movable jaw 18 (or 18A) is supported on the intermediate transverse pin 22, as shown in FIG. 2, which can be done easily and quickly without need for tools, a work-piece of any size within the range from about six inches up to sixteen inches can be clamped. The clamping capacity may be further increased by supporting the movable jaw on the outermost transverse pin 24, as shown in FIG. 3; this arrangement enables clamping a work-piece of any size within the range from about sixteen inches up to about twenty-four inches. Thus, a clamp having the indicated dimensions is capable of clamping a work-piece of any size within the range from essentially zero up to twenty-four inches, a capacity approximately six inches greater than the closed length of approximately eighteen inches.

It will have become apparent from the foregoing description that the clamping tool in accordance with the invention is relatively compact when closed, has a large clamping capacity, it closes easily from an open to a clamping position, and provides extremely high clamping forces. Clamps having maximum openings between the jaws different from those described can be provided simply by changing the lengths of the slide bar and the sleeve in correct proportion and also the spacing between the mounting locations for the movable jaw.

It will now be evident to ones skilled in the art that certain modifications and changes may be made in the described construction without departing from the spirit and scope of the invention. For example, the dimensions of the slide bar and sleeve may differ from those of the described example, the jaw structures may differ in details from those shown and the ratchet and pawl mechanism may also differ in details. It is intended that all matter contained in the above description or shown in the accompanying drawings shall be interpreted as illustrative and not in a limiting sense.

I claim:

1. A woodworker's bar clamp comprising:

an elongate slide bar;

a fixed jaw and first support means for pivotally securing said fixed jaw to one end of said slide bar;

an elongate hollow sleeve having a top wall and adjacent side walls for receiving at one end the other end of said slide bar and supporting said bar for back and forth movement relative to said sleeve;

a movable jaw and second support means for mounting said movable jaw on the top wall of said sleeve at a location selected from plural locations spaced along the length of said sleeve for movement along with said sleeve toward and away from said fixed jaw; and means for releasably maintaining the slide bar at a desired adjusted position along said sleeve for clamping a work-piece between the fixed and movable jaws with hand-applied pressure.

2. A bar clamp as defined in claim 1, wherein said sleeve has three locations at which said movable jaw may be mounted, one location near each end of said sleeve and a third location substantially equidistant from the ends of the sleeve.

3. A bar clamp as defined in claim 2, wherein said means for supporting the slide bar for back and forth movement relative to the sleeve comprises three pins, one at each of said three locations, each extending transversely of the sleeve, proximate the lower edge of said sleeve.

4. A bar clamp as defined in claim 3, wherein each of said transversely extending pins projects outwardly from both side walls of the sleeve, and wherein said second support means includes means for engaging the projections of a transverse pin for releasably securing the movable jaw to the sleeve at a desired one of said three location.

5. A bar clamp as defined in claim 1, wherein said slide bar has opposing flat side surfaces, and wherein said means for releasably maintaining said slide bar at a desired adjusted clamping position within said sleeve comprises a multiplicity of ratchet teeth distributed along at least a portion of the length of one side surface of said slide bar, and pawl means supported on a side wall of said sleeve and arranged to releasably engage the ratchet teeth on said slide bar.

6. A bar clamp as defined in claim 4, wherein said slide bar is flat with opposing side surfaces, and wherein said means for maintaining the slide bar at a desired adjusted position within said sleeve comprises ratchet teeth distributed along a side surface of said slide bar, and pawl means supported on a side wall of said sleeve and arranged to releasably engage said ratchet teeth.

7. A bar clamp as defined in claim 1, wherein said fixed jaw is pivotally supported on said first support means and said first support means is spring-biased away from said movable jaw, and wherein said first support means includes means adapted to engage said slide bar and, when engaged, tilts said first support means toward said movable jaw for greatly increaseing the clamping pressure between the jaws over that which can be applied by hand pressure alone.

8. A bar clamp as defined in claim 5, wherein said fixed jaw is pivotally supported on said first support means for maintaining parallelism between said fixed jaw and said movable jaw for all angles of tilt of said first support means, wherein said first support means is spring-biased to tilt said fixed jaw away from said movable jaw, and wherein said first support means includes an integral arm disposed substantially parallel to the longitudinal axis of said slide bar, and means threadedly engaging said integral arm and adapted to engage said slide bar and, when engaged, tilting said first support means toward said movable jaw for greatly increaseing the clamping pressure between the jaws over that which can be applied by hand pressure alone.

9. A bar clamp as defined in claim 4, wherein said sleeve is tubular and has a top wall of inverted "U"-shape and adjacent side walls, and wherein said second support means comprises a pair of opposed plates each having a hook-shaped cutout at a lower end which faces said fixed jaw and is adapted to engage a respective pin projection, and a block disposed between said plates, upwardly from their lower end a distance approximating the width of the side walls of said sleeve and separating said plates by substantially the width of the top wall of said sleeve, said block having a lower surface contoured to substantially match the inverted "U"-shaped contour of the upper wall of said sleeve.

10. A woodworker's bar clamp comprising:

an elongate tubular sleeve having a top wall and adjacent side walls;

a movable jaw and first support means for mounting said movable jaw on the top wall of said sleeve at a mounting location selected from plural mounting locations spaced along the length of said sleeve;

an elongate slide bar, one end of which is received and supported within said sleeve for back and forth movement relative to said sleeve;

a fixed jaw and second support means for pivotally securing said fixed jaw to the other end of said slide bar, facing said movable jaw; and means for maintaining said sleeve at an adjusted position along said slide bar for clamping a work-piece between the fixed and movable jaws with hand-applied pressure.

11. A bar clamp as defined in claim 10, wherein said sleeve has three mounting locations, one near each end of the sleeve and a third substantially equidistant from the ends of the sleeve.

12. A bar clamp as defined in claim 11, wherein each mounting location is defined by a pin which extends transversely of said sleeve, proximate its lower edge, and projects outwardly from both side walls, wherein said pins support said slide bar for movement relative to said sleeve, and wherein the projections of each pin are adapted to be engaged by said first support means for releasably mounting said movable jaw at a desired mounting location on said sleeve.

13. A bar clamp as defined in claim 12, wherein said slide bar has opposing flat side surfaces, and wherein said means for maintaining said sleeve at an adjusted position along the length of said slide bar comprises ratchet teeth distributed along a side surface of said slide bar, and pawl means supported on a side wall of said sleeve and arranged to releasably engage said ratchet teeth.

14. A bar clamp as defined in claim 13, wherein said fixed jaw is pivotally supported on said second support means, and wherein said second support means includes threaded means adapted to engage an edge of said slide bar and, when engaged and actuated, tilts said second support means toward said movable jaw for greatly increasing the clamping pressure between the jaws over that which can be applied by hand.

15. A woodworker's clamp comprising an elongate tubular sleeve having a top wall of inverted "U"-shape and adjacent side walls, and three locations for mounting a movable jaw, each location defined by a pin which extends transversely through said sleeve proximate its lower edge and which projects outwardly from both side walls:

a flat elongate side bar supported within said sleeve on said transverse pins for back and forth movement relative to said sleeve;

a fixed jaw and first support means for pivotally securing said fixed jaw to a free end of said slide bar;

a movable jaw and second support means for releasably mounting said movable jaw at a selected mounting location on said sleeve, wherein said second support means includes a pair of plates each having a hook-shaped cutout at a lower end adapted to engage a respective projection of a transverse pin and a block between said plates and spaced upwardly from the lower end a distance approximately the width of the sleeve side walls and separating said plates by substantially the width of the top wall of said sleeve, said block having a lower surface contoured to substantially match the inverted "U"-shaped contour of the upper wall of the sleeve; and means for locking said slide bar and said sleeve against relative movement upon clamping a work-piece between said fixed and movable jaws with hand-applied pressure, said means for locking comprising ratchet teeth distributed along said slide bar and pawl means supported on a side wall of said sleeve and arranged to releasably engage said ratchet teeth;

wherein said first support means includes an integral arm disposed substantially parallel to the longitudinal axis of said slide bar, and means threadably engaging said integral arm and adapted to engage said slide bar and, when engaged, tilts said first support means toward said movable jaw for increasing the clamping pressure between the jaws over that which can be applied by hand pressure alone.

* * * * *